United States Patent [19]

Eriksson et al.

[11] Patent Number: 4,665,549

[45] Date of Patent: May 12, 1987

[54] HYBRID ACTIVE SILENCER

[75] Inventors: Larry J. Eriksson, Madison; Mark C. Allie, Oregon; Richard H. Hoops, Stoughton, all of Wis.

[73] Assignee: Nelson Industries Inc., Stoughton, Wis.

[21] Appl. No.: 811,029

[22] Filed: Dec. 18, 1985

[51] Int. Cl.[4] ..... E04B 1/99

[52] U.S. Cl. ..... 381/71; 181/222

[58] Field of Search ..... 381/71; 181/224, 222, 181/252, 258

[56] References Cited

U.S. PATENT DOCUMENTS

| | | | |
|---|---|---|---|
| 2,983,790 | 5/1961 | Olson | 381/71 |
| 3,936,606 | 2/1976 | Wanke . | |
| 4,025,724 | 5/1977 | Davidson, Jr. et al. . | |
| 4,109,108 | 8/1978 | Coxon | 381/71 |
| 4,122,303 | 10/1978 | Chaplin | 381/71 |
| 4,473,906 | 9/1984 | Warnaka et al. . | |
| 4,489,441 | 12/1984 | Chaplin | 381/71 |
| 4,527,282 | 7/1985 | Chaplin | 381/71 |

OTHER PUBLICATIONS

"Active Noise Reduction Systems in Ducts", J. Tichy, G. E. Warnaka and L. A. Poole, *ASME Journal*, Nov. 1984, pp. 1-7.

"Historical Review and Recent Development of Active Attenuators", H. G., Leventhall, Acoustical Society of America, 104th Meeting, Orlando, Nov. 1982, FIG. 8.

"Active Adaptive Sound Control in a Duct: A Computer Simulation", J. C. Burgess, Journal of Acoustic Society of America, 70(3), Sep., 1981, pp. 715-726.

"The Implementation of Digital Filters Using a Modified Widrow-Hoff Algorithm for the Adaptive Cancellation of Acoustic Noise", L. A. Poole, G. E. Warnaka and Richard C. Cutter, 1984, *IEEE*, CH 1945-5/84/00-00-0233, pp. 21.7.1-21.7.4.

"VLSI Systems Designed for Digital Signal Processing", Bowen and Brown, vol. 1, Prentice Hall, Englewood Cliffs, N.J., 1982, pp. 80-87.

"Comments on 'An Adaptive Recursive LMS Filter'", Widrow et al., *Proceedings of the IEEE*, vol. 65, No. 9, Sep. 1977, pp. 1402-1404, FIG. 2.

Elliot and Nelson, I.S.V.R. Technical Report No. 127, Southampton University, England, published in U.S. Department of Commerce, National Technical Information Service, Bulletin No. PB85-189777, Apr. 1984, pp. 1-61.

Morgan "An Analysis of Multiple Correlation Cancellation Loops With a Filter in the Auxiliary Path", IEEE Transactions Acoustics Speech, Signal Processing, vol. ASSP-28, No. 4, pp. 454-467.

"Echo Cancellation Algorithms", Gritton and Lin, *IEEE ASSP Magazine*, Apr. 1984, pp. 30-38.

"Aspects of Network and System Theory", Widrow, *Adaptive Filters*, edited by R. E. Kalman and N. DeClaris, Holt, Reinhart and Winston, N.Y., 1971, pp. 563-587.

Gale Models HP, MP, LP, DS, DS-LP, SS and SS-LP. Industrial Acoustics Company, Duct Silencers, Application Manual Bulletin 1.0301.2.

Universal Silencer, Division of Nelson Industries, Models U2 and SU5.

Sanders, "Silencers: Their Design and Application", *Sound and Vibration*, Feb. 1968, pp. 6-13.

"Acoustical Turning Vanes", *HVAC Auxiliary Products*, Gale Corporation, Noise Containment Division, P.O. Box 183, North Brunswick, N.J. 08902.

*Primary Examiner*—Gene Z. Rubinson
*Assistant Examiner*—L. C. Schroeder
*Attorney, Agent, or Firm*—Andrus, Sceales, Starke & Sawall

[57] ABSTRACT

Acoustic attenuation apparatus (2) is provided for a duct (4) guiding an acoustic wave propagating (6) therethrough. A silencer (8) is provided for passively attenuating the acoustic wave in the duct, and a cancelling speaker (32) is provided within the silencer. The combination provides hybrid active/passive combined attenuation. Various rectangular and circular structures are disclosed, together with multi-path and multi-speaker arrangements.

23 Claims, 9 Drawing Figures

FIG. 1
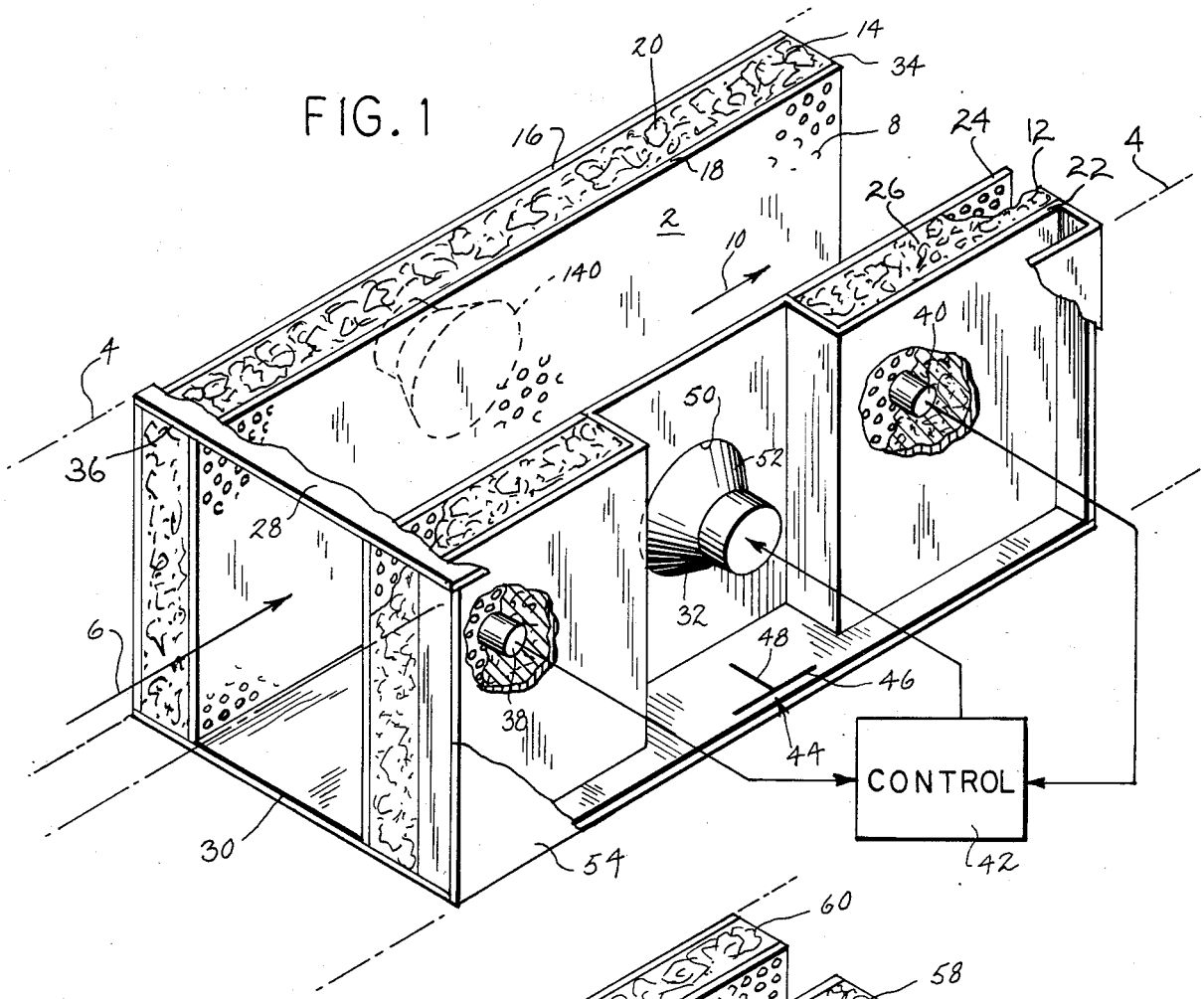
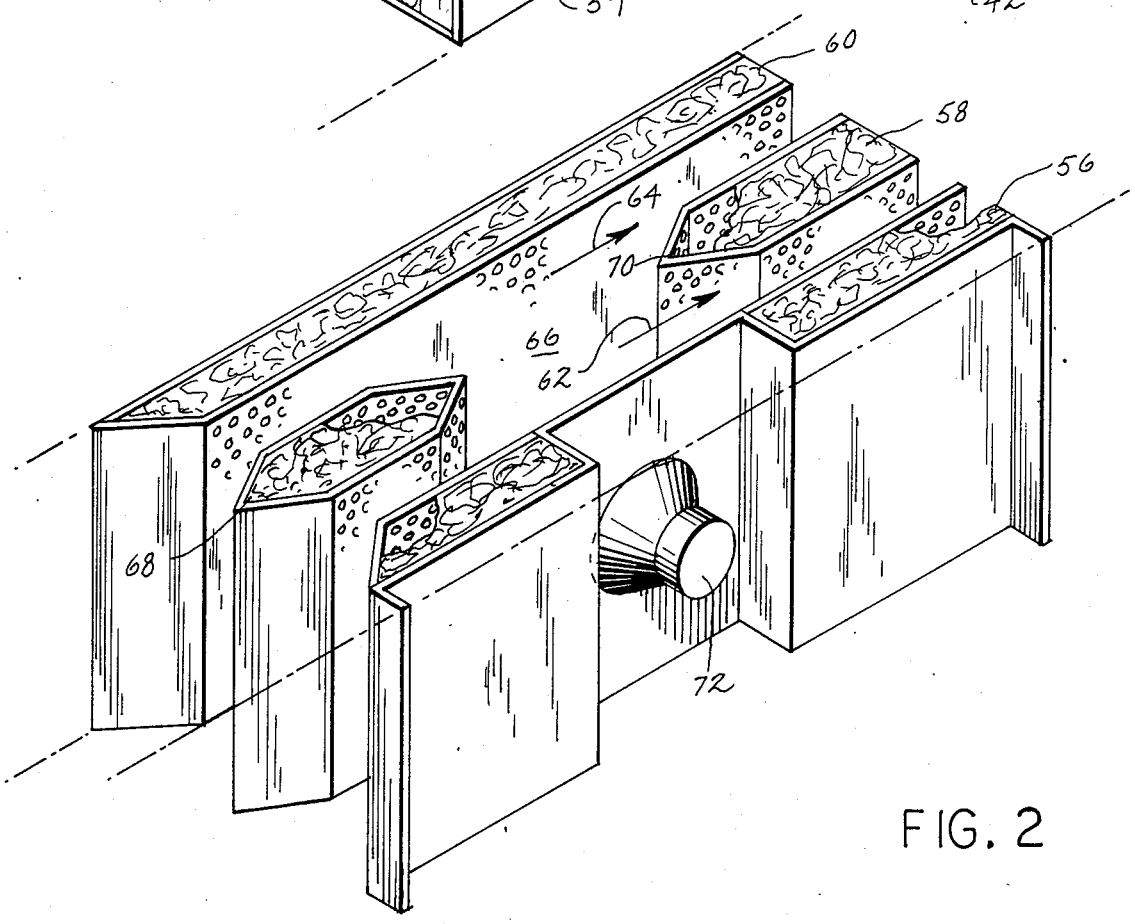
FIG. 2

HYBRID ACTIVE SILENCER

BACKGROUND AND SUMMARY

The invention relates to active acoustic attenuation systems.

Active acoustic attenuation is accomplished by sound wave interference. Undesirable noise propagating down a duct is attenuated by the introduction of cancelling sound into the duct which ideally is a mirror image of the undesirable sound, to thus cancel same. For further background, reference is made to: Warnaka et al U.S. Pat. No. 4,473,906; Davidson, Jr. et al U.S. Pat. No. 4,025,724; "Active Noise Reduction Systems in Ducts", J. Tichy, G. E. Warnaka and L. A. Poole, *ASME Journal,* November 1984, pp. 1–7; "Historical Review and Recent Development of Active Attenuators", H. G. Leventhall, *Acoustical Society of America,* 104th Meeting, Orlando, November 1982, "Active Adaptive Sound Control in a Duct: A Computer Simulation", J. C. Burgess, *Journal of Acoustic Society of America,* 70(3), September 1981, pp. 715–726; and "Echo Cancellation Algorithms", Gritton and Lin, *IEEE ASSP Magazine,* April 1984, pp. 30–38.

In prior systems, the cancelling speaker is typically mounted to the outside of the duct, or connected to the duct by a wave guide. However, in these configurations, the back of the cancelling speaker must be enclosed to prevent the acoustical noise radiated from the back of the speaker from generating additional undesirable noise outside the duct. In addition, the adaptive control process that is used to generate the cancelling signal can be adversely affected by acoustical reflections from distant elements in the overall duct system. Furthermore, active attenuation is most useful on low frequency noises and thus must be used in combination with separate passive silencers, upstream and/or downstream of the cancelling speaker, to obtain attenuation over a broad range of frequencies. Passive silencers are well known in the art, for example Sanders, "Silencers: Their Design and Application", *Sound and Vibration,* February 1968, pp. 6–13.

Wanke U.S. Pat. No. 3,936,606 shows a speaker in a duct, and mounting structure positioned to block the backward pressure wave. There is also shown a cone diffuser positioned axially oppositely the apex of the cone diaphragm.

The present invention addresses and solves the above noted and other problems. A hybrid active silencer is described that incorporates active and passive silencing in a single unit. The cancelling speaker is located within a silencer structure that has been designed to eliminate radiation from the back of the speaker outside the duct. The invention also acoustically isolates the active attenuation system from distant reflections in the duct system to simplify the adaptive control process. The invention also provides sound attenuation at the higher frequencies where active attenuation is more difficult. The complete hybrid silencer provides effective silencing over a very broad range of frequencies. Various advantageous constructions and features are provided. The invention is particularly useful with the active attenuation systems in co-pending application Ser. No. 777,928, filed Sept. 19, 1985 for "Active Sound Attenuation System With On-Line Adaptive Feedback", and co-pending application Ser. No. 777,825, filed Sept. 19, 1985 for "Fully Adaptive Active Attenuation System".

The invention enables the use of omni directional speakers and microphones, and is amenable to various types of complex sound structures and environments. This is desirable because unidirectional speaker or microphone arrays are more expensive. Also, simple time delay modeling has only limited application, particularly in view of the increasingly complex sound environments actually encountered in the field.

BRIEF DESCRIPTION OF THE DRAWINGS

FIG. 1 is an isometric schematic illustration of acoustic attenuation apparatus constructed in accordance with the invention.

FIG. 2 is a view like FIG. 1 and shows an alternate embodiment.

DETAILED DESCRIPTION

Figure 3:
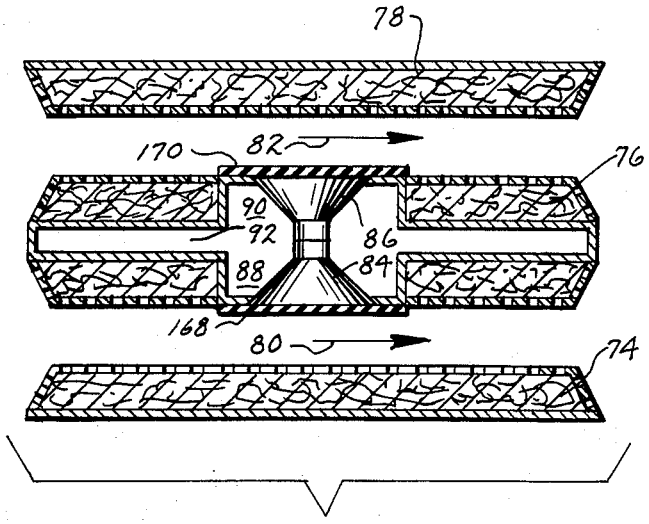
FIG. 3 is a top sectional view showing another embodiment.

FIG. 1 shows acoustic attenuation apparatus 2 for a rectangular duct 4 guiding an acoustic wave propagating axially rightwardly therethrough as shown at 6. A silencer 8 is provided in the duct for passively attenuating the acoustic wave. This silencer comprises an acoustically absorptive wall structure extending parallel to the acoustic propagation path through the duct and defining an axial flow path therethrough as shown at 10 between the wall sections such as 12 and 14 laterally spaced on opposite sides of path 10. Wall section 14 is provided by a solid outer wall 16, a perforated inner wall 18, and acoustically absorptive material 20 packed therebetween. Wall section 12 includes outer solid wall 22, inner perforated wall 24 and acoustically absorptive material 26 packed therebetween. Top and bottom walls 28 and 30 may or may not include acoustically absorptive material. For further background regarding duct silencers, reference is made to: the above noted Sanders article; Gale Co. Models HP, MP, LP, DS, DS-LP, SS and SS-LP; Industrial Acoustics Company, Duct Silencers, Application Manual Bulletin 1.0301.2; and Universal Silencer, Division of Nelson Industries, Models U2 and SU5.

A sound source or cancelling speaker 32 is provided within silencer 8 for injecting a cancelling acoustic wave into axial flow path 10 for cancelling the undesirable noise within duct 4 from path 6. Speaker 32 is between and preferably equally spaced from the axial ends 34 and 36 of the silencer to isolate speaker 32 from duct reflections, to provide hybrid active/passive combined attenuation. An input microphone 38 senses the input noise from the duct, and an output error microphone 40 senses the combined output noise. These signals are fed to a controller 42 which then outputs a correction signal to speaker 32 to control the cancelling sound until the output sound at 40 is null, or otherwise reduced as desired.

In FIG. 1, cancelling speaker 32 is disposed in wall section 12. Wall 12 has a T-shaped space formed therein as shown at 44, with the cross-bar 46 of the T extending axially, and the central stem 48 of the T extending laterally inwardly toward the axial flow path 10. The acoustically absorptive packing material 26 is between the cross-bar 46 of the T and axial flow path 10. Speaker 32 is disposed in the lateral stem portion 48 of the T space and faces axial flow path 10. The face 50 of the speaker is mounted in a receiving aperture 52 in inner sidewall 24. The right outer sidewall 54 of the duct closes the T space. The open volume behind speaker 32 provided by T space 44 has been found to provide desirable loading of the speaker for better acoustic performance.

FIG. 2 is a view like FIG. 1 and shows another embodiment, with the top, bottom and right side walls removed. First, second and third laterally spaced acoustically absorptive wall sections 56, 58 and 60 define respective first and second axial flow paths 62 and 64 through the silencer. Second wall section 58 has an intermediate axial gap 66 therein defining axially forward and rearward segments 68 and 70. Forward segment 68 is a splitter section laterally spaced between wall sections 56 and 60. The first and second axial flow paths 62 and 64 communicate through gap 66. Speaker 72 is in first wall section 56 and injects a cancelling acoustic wave into the first axial flow path 62. Gap 66 is laterally opposite speaker 72 such that the injected cancelling acoustic wave propagates through gap 66 and is also injected into the second axial flow path 64.

FIG. 3 shows a top sectional view of another embodiment. First, second and third laterally spaced acoustically absorptive wall sections 74, 76 and 78 define respective first and second axial flow paths 80 and 82. Second wall section 76 is a splitter section laterally spaced between the first and third wall sections 74 and 78. A first cancelling speaker 84 is in the central wall section 76 and injects a first cancelling acoustic wave into first axial flow path 80. A second cancelling speaker 86 is also in central wall section 76 and injects a second cancelling acoustic wave into the second axial flow path 82. Each of the speakers 84 and 86 has its respective T space 88 and 90. Speakers 84 and 86 are colaterally aligned back-to-back and face oppositely. T spaces 88 and 90 are likewise back-to-back and face oppositely, and share the same space for the cross-bar of the T at 92.

Figure 4:
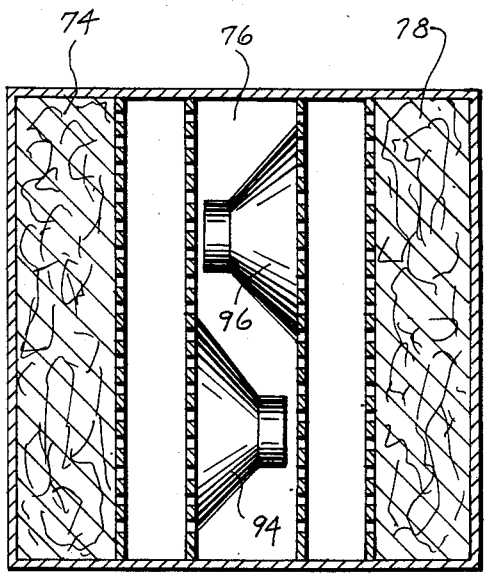
FIG. 4 is an end sectional view showing another embodiment.

FIG. 4 is a sectional end view of an alternative to FIG. 3, and like reference numerals are used where appropriate to facilitate clarity. First and second cancelling speakers 94 and 96 are in the central wall section and face oppositely, as in FIG. 3. However, speakers 94 and 96 are laterally overlapped, with speaker 96 above speaker 94. This reduces the lateral thickness requirement of the central wall section.

Figure 5:
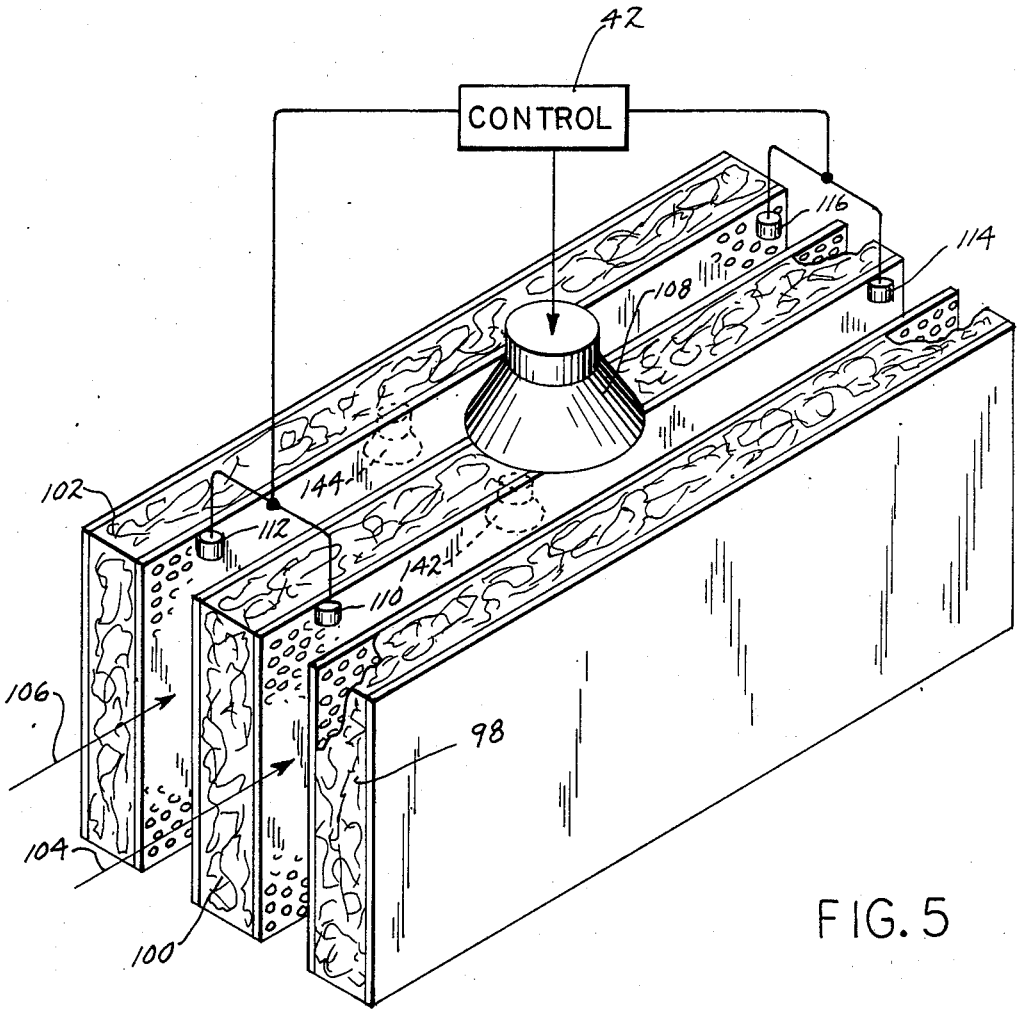
FIG. 5 is a view like FIG. 1 and shows another embodiment.

In FIG. 5, first, second and third laterally spaced acoustically absorptive wall sections 98, 100 and 102 define first and second axial flow paths 104 and 106 through the silencer. Central section 100 is a splitter section. Cancelling speaker 108 straddles central section 100 and injects cancelling acoustic waves into both axial flow paths 104 and 106. Each path may have an input microphone 110 and 112, and an error output microphone 114 and 116.

Figure 6:
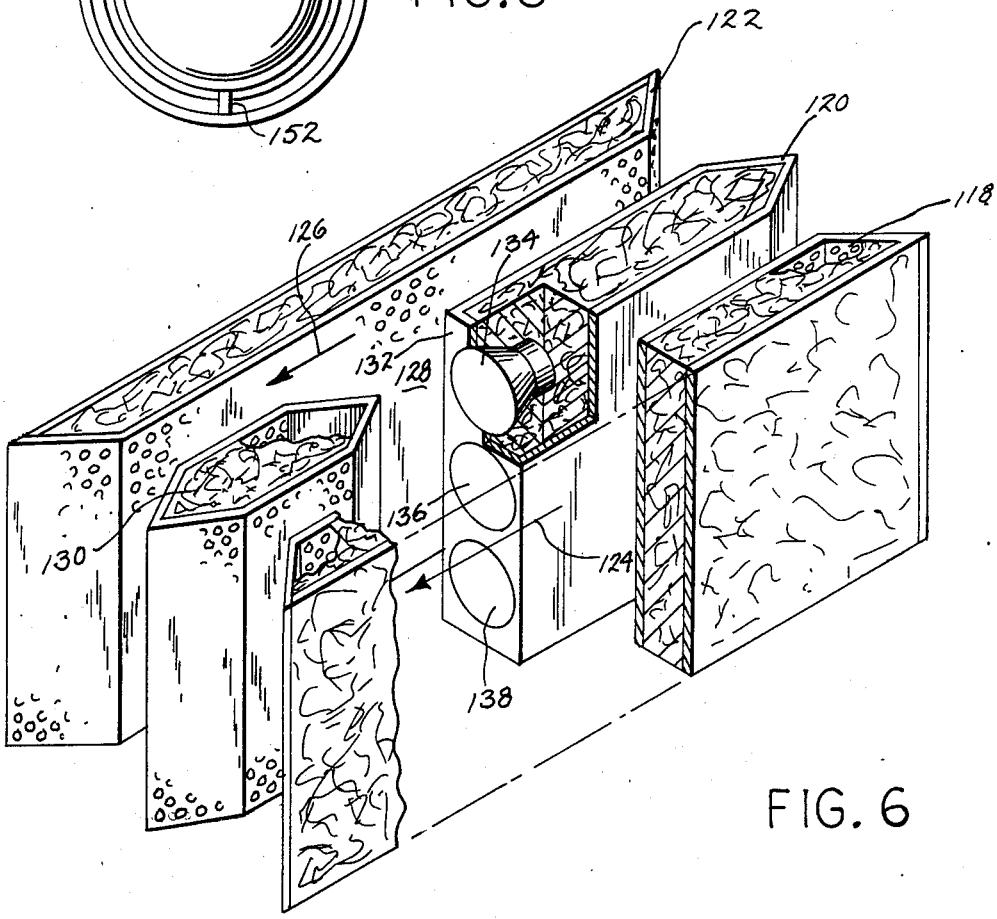
FIG. 6is a view like FIG. 1 and shows another embodiment.

In FIG. 6, first, second and third laterally spaced acoustically absorptive wall sections 118, 120 and 122 define first and second axial flow paths 124 and 126 through the silencer. The central wall section 120 is a splitter section and has an intermediate axial gap 128 defining axially forward and rearward segments 130 and 132. The axial flow paths 124 and 126 communicate through gap 128. Cancelling speaker 134 is in the axially rearward segment 132. As shown in FIG. 6, a plurality of additional cancelling speakers such as 136 and 138 may be colinearly aligned one above another in rear segment 132.

In further alternatives, a pair of cancelling speakers may face each other within the silencer and inject sound toward each other, for example as shown in FIG. 1 at speaker 32 and at speaker 140 shown in dashed line. Opposing speakers 32 and 140 may alternatively be disposed in the upper and lower sidewalls 28 and 30, respectively, of the silencer. The speakers may also be axially offset from one another. In another alternative in FIG. 5, a pair of speakers may be provided, as shown in dashed line at 142 and 144, one speaker on each side of central splitter section 100.

Figure 7:
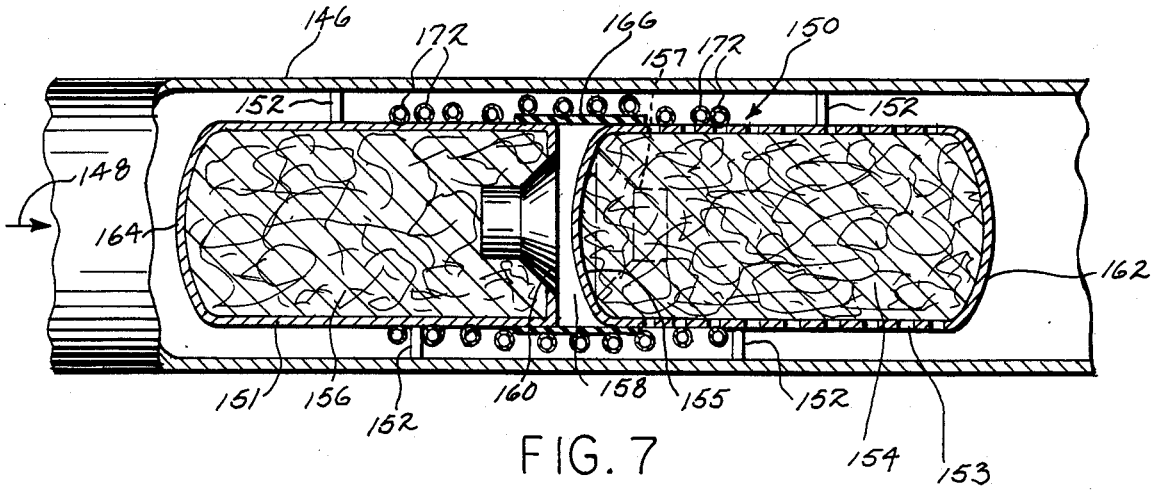
FIG. 7 is a side view partially cut away of another embodiment of the invention including a cylindrical bullet-like split silencer.
Figure 8:
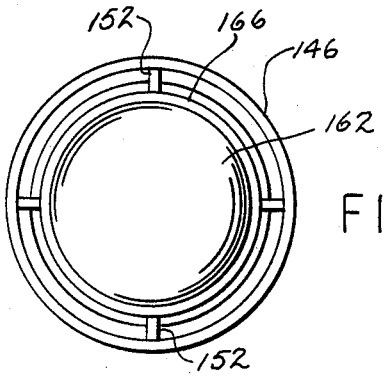
FIG. 8 is an end view of FIG. 7.

FIG. 7 shows acoustic attenuation apparatus for a round duct 146 guiding an acoustic wave propagating axially rightwardly therethrough as shown at 148. It is known to provide a cylindrical bullet-like silencer 150 of acoustically absorptive material within the duct supported by radial spokes or the like 152, for example as provided by the above noted commercial models. In the present invention, the bullet-like cylindrical silencer is split into two segments, an axially forward segment 154 and an axially rearward segment 156 separated by a small axial gap 158 therebetween. Cancelling speaker 160 is in rearward segment 156 and faces axially rightwardly downstream toward forward segment 154 across axial gap 158 for injecting a cancelling acoustic wave toward the acoustically absorptive forward segment 154 and laterally therearound and into the axial flow path. Cancelling speaker 160 is between and spaced from the axial ends 162 and 164 of the bullet-like silencer to isolate cancelling speaker 160 from duct reflections, to provide hybrid active/passive combined attenuation.

Rearward segment 156 has a smooth nonperforated cylindrical sidewall 151, and a nonperforated rear wall 164. Forward segment 154 has a perforated cylindrical sidewall 153, a non-perforated front wall 162, and a non-perforated rear wall 155. In an alternative, an aperture is provided in wall 155 and a second cancelling speaker 157 is provided thereat facing axially rearwardly toward speaker 160.

In FIG. 7, a thin protective layer of acoustically transmissive material 166, such as a polymeric rubber-like material, e.g., silicone rubber, is wrapped cylindrically around and seals axial gap 158 between forward and rearward segments 154 and 156 to protect speaker 160, and speaker 157, from corrosive elements, particle-laden gas, and the like. The transmission loss of thin sheets of rubber is very low at frequencies less than about 500 Hz, and hence does not significantly impair the active acoustic attenuation in such frequency range, which is within the typical range of interest for duct silencing applications. Each of the previous embodiments may be provided with a thin layer of material covering the cancelling speaker, for example as shown at 168 and 170 in FIG. 3, resisting corrosion and transmitting low frequency acoustic waves less than about 500 Hz.

Further in FIG. 7, a fluid conduit cooling coil 172 is wrapped cylindrically around cancelling speaker 160 and rearward segment 156 to enable cooling when used in implementations involving hot gases or the like, for example an exhaust system. This feature may also be part of a waste heat recovery system. The cooling coil may also be provided in the above embodiments.

Figure 9:
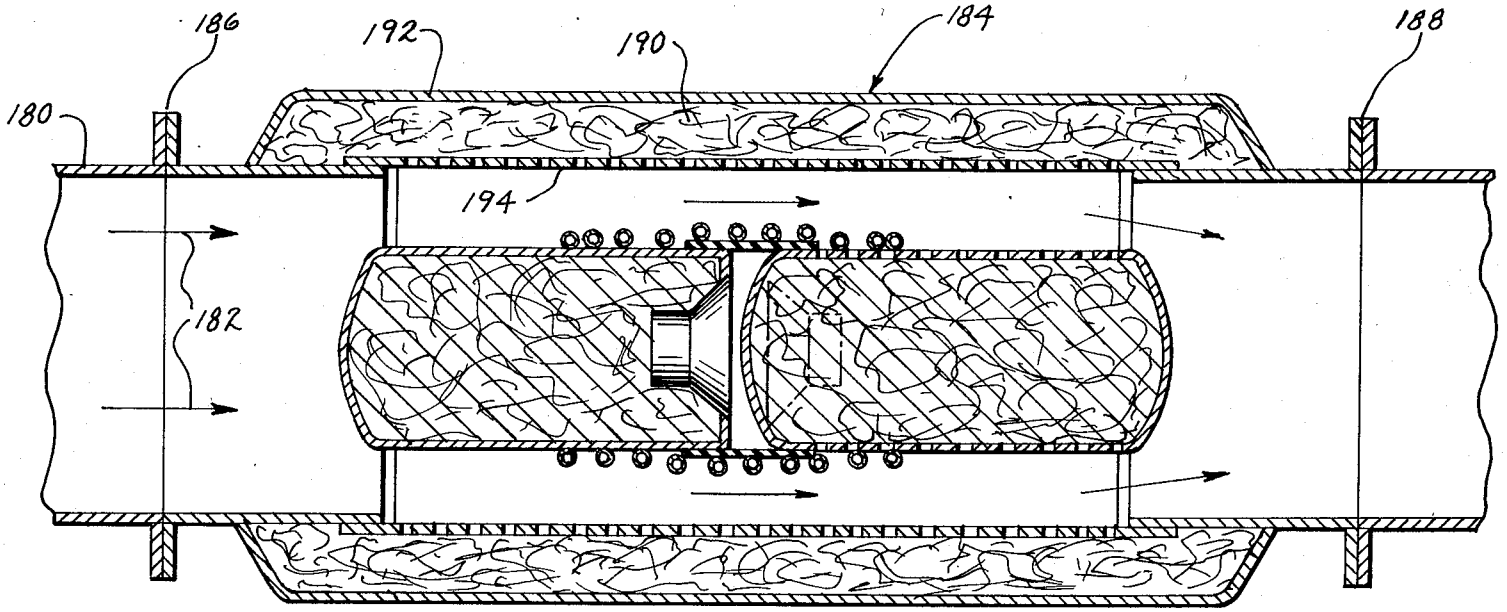
FIG. 9 shows an alternative to FIG. 7.

FIG. 9 illustrates an alternative to FIG. 7 and like reference numerals are used where appropriate to facilitate clarity. Round duct 180 guides an acoustic wave propagating axially rightwardly therethrough as shown at 182. Cylindrical bullet-like silencer 184 is interposed in series in the duct at mounting flanges 186 and 188. The silencer includes central bullet-like member 150 as in FIG. 7, and an outer concentric cylindrical acoustically absorptive wall structure 190 including outer solid wall 192 and inner perforated wall 194 with acoustically absorptive packing material therebetween.

It is recognized that various alternatives and modifications are possible within the scope of the appended claims.

We claim:

1. Acoustic attenuation apparatus for a duct guiding an acoustic wave propagating therethrough, comprising:

a silencer for passively attenuating the acoustic wave in the duct, said silencer comprising acoustically absorptive material defining a flow path through the duct; and a sound source within said silencer for injecting a cancelling acoustic wave into said flow path, said sound source being between and spaced from the ends of said silencer to isolate said sound source from duct reflections, to provide hybrid active/-passive combined attenuation, wherein said silencer has a central splitter wall section, and comprising a pair of said sound sources, one on each side of said splitter.

2. Acoustic attenuation apparatus for a duct guiding an acoustic wave propagating therethrough, comprising:

a silencer for passively attenuating the acoustic wave in the duct, said silencer comprising an acoustically absorptive wall structure extending parallel to the acoustic propagation flow path through the duct; and a sound source disposed in said silencer wall structure for injecting a cancelling acoustic wave into said flow path to actively attenuate said acoustic wave, said sound source being between and spaced from the ends of said wall structure to isolate said sound source from duct reflections, to provide hybrid active/passive combined attenuation, wherein said wall structure is packed with acoustically absorptive packing material and has a T-shaped space formed therein with the cross-bar of the T extending parallel to said flow path and the central stem of the T extending from said cross-bar laterally toward said flow path, said packing material being between said cross-bar of the T and said flow path, said sound source being disposed in said lateral central stem of the T and facing said flow path.

3. Acoustic attenuation apparatus for a duct guiding an acoustic wave propagating therethrough, comprising:

a silencer for passively attenuating the acoustic wave in the duct, said silencer comprising an acoustically absorptive wall structure extending parallel to the acoustic propagation flow path through the duct; and a sound source disposed in said silencer wall structure for injecting a cancelling acoustic wave into said flow path to actively attenuate said acoustic wave, said sound source being between and spaced from the ends of said wall structure to isolate said sound source from duct reflections, to provide hybrid active/passive combined attenuation, wherein said silencer wall structure comprises a central splitter wall section defining first and second said flow paths on laterally opposite sides thereof.

4. The invention according to claim 3 wherein said silencer wall structure comprises first, second and third laterally spaced wall sections defining said first and second flow paths, said second wall section being said central splitter wall section laterally spaced between said first and third wall sections, and wherein said sound source is in said first wall section and injects said cancelling acoustic wave into said first flow path, and wherein said second wall section has a gap defining forward and rearward segments, said first and second flow paths communicating laterally through said gap, said gap being laterally opposite said sound source such that said injected cancelling acoustic wave propagates through said gap and is also injected into said second flow path

5. The invention according to claim 3 comprising a first said sound source in said central wall section and injecting a first said cancelling acoustic wave into said first flow path, and a second said sound source also in said central wall section and injecting a second said cancelling wave into said second flow path.

6. The invention according to claim 5 wherein said first and second sound sources are colaterally aligned back-to-back and face oppositely.

7. The invention according to claim 5 wherein said first and second sound sources face oppositely and are laterally overlapped with one said sound source above the other said sound source.

8. The invention according to claim 3 wherein said sound source straddles said central wall section and injects cancelling acoustic waves into each of said first and second flow paths.

9. The invention according to claim 3 wherein said central wall section has a gap defining forward and rearward segments, said first and second flow paths communicating through said gap, wherein said sound source is in said rearward segment of said central wall section.

10. The invention according to claim 9 comprising a plurality of said sound sources colinearly aligned one above another in said axially rearward segment of said central wall section.

11. Acoustic attenuation apparatus for a duct guiding an acoustic wave propagating therethrough, comprising:

a silencer for passively attenuating the acoustic wave in the duct, said silencer comprising an acoustically absorptive wall structure extending parallel to the acoustic propagation flow path through the duct, a sound source disposed in said silencer wall structure for injecting a cancelling acoustic wave into said flow path to actively attenuate said acoustic wave, said sound source being between and spaced from the ends of said wall structure to isolate said sound source from duct reflections, to provide hybrid active/passive combined attenuation; and a thin protective layer of acoustically transmissive material covering said sound source and resisting corrosion and transmitting low frequency acoustic waves less than about 500 Hz.

12. Acoustic attentuation apparatus for a duct guiding an acoustic wave propagating therethrough, comprising:

a silencer for passively attenuating the acoustic wave in the duct, said silencer comprising an acoustically absorptive wall structure extending parallel to the acoustic propagation flow path through the duct;

a sound source disposed in said silencer wall structure for injecting a cancelling acoustic wave into said flow path to actively attenuate said acoustic wave, said sound source being between and spaced from the ends of said wall structure to isolate said sound source from duct reflections, to provide hybrid active/passive combined attenuation; and a fluid conduit cooling coil wrapped around said sound source.

13. Acoustic attenutation apparatus for a round duct guiding an acoustic wave propagating therethrough, comprising:

a cylindrical bullet-like silencer of acoustically absorptive material for passively attenuating the acoustic wave in the duct, said silencer being split into two segments, a forward segment and a rearward segment separated by a gap therebetween; and a sound source in said rearward segment of said acoustically absorptive bullet-like silencer and facing toward said forward segment of said acoustically absorptive bullet-like silencer across said gap for injecting a cancelling acoustic wave toward said acoustically absorptive forward segment and laterally therearound and into said flow path, said sound source being between and spaced from the ends of said bulletlike silencer to isolate said sound source from duct reflections, to provide hybrid active/passive combined attenuation.

14. The invention according to claim 13 wherein:

said rearward segment of said cylindrical bullet-like silencer has a non-perforated rear wall and a cylindrical non-perforated sidewall; and said forward segment of said cylindrical bullet-like silencer has a non-perforated front wall, a perforated cylindrical sidewall, and a non-perforated rear wall.

15. The invention according to claim 13 comprising a second sound source in said forward segment of said cylindrical bullet-like silencer and facing rearwardly toward said rearward segment.

16. The invention according to claim 13 comprising a thin protective layer of acoustically transmissive material covering said sound source and resisting corrosion and transmitting low frequency acoustic waves less than about 500 Hz.

17. The invention according to claim 13 comprising a thin protective layer of acoustically transmissive material wrapped cylindrically around and sealing the gap between said forward and rearward segments of said bullet-like silencer to protect said sound source from corrosive elements and passing low frequency sound less than about 500 Hz.

18. The invention according to claim 13 comprising a fluid conduit cooling coil wrapped cylindrically around said sound source and said rearward segment of said bullet-like silencer.

19. Acoustic attenuation apparatus for a round duct guiding an acoustic wave propagating therethrough, comprising:

a cylindrical silencer for passively attenuating the acoustic wave in the duct, said cylindrical silencer comprising an outer acoustically absorptive cylindrical wall structure extending parallel to the propagation path of the acoustic wave, and a central cylindrical bullet-like member of acoustically absorptive material spaced radially inwardly from said outer wall structure to define an annular flow path between said outer wall structure and said central bullet-like member, said central bullet-like member being split into two segments, a forward segment and a rearward segment separated by a gap therebetween; and a sound source in said rearward segment of said central bullet-like member and facing toward said forward segment across said gap for injecting a cancelling acoustic wave toward said forward segment and laterally therearound and into said annular flow path, said sound source being between and spaced from the ends of said silencer to isolate said sound source from duct reflections, to provide hybrid active/passive combined attenuation.

20. The invention according to claim 19 wherein said cylindrical outer wall structure and said forward segment of said central bullet-like member have perforated wall sections and acoustically absorptive material packed therein.

21. Acoustic attenuation appartus for a round duct guiding an acoustic wave propagating therethrough, comprising:

a cylindrical bullet-like silencer of acoustically absorptive material for passively attenuating the acoustic wave in the duct, said silencer being split into two segments, a forward segment and a rearward segment separated by a gap therebetween; and a sound source in said forward segment of said acoustically absorptive bullet-like silencer and facing toward said rearward segment of said acoustically absorptive bullet-like silencer across said gap for injecting a cancelling acoustic wave toward said rearward segment and laterally therearound and into said flow path, said sound source being between and spaced from the ends of said bullet-like silencer to isolate said sound source from duct reflections, to provide hybrid active/passive combined attenuation.

22. The invention according to claim 21 comprising a thin protective layer of acoustically transmissive material covering said sound source and resisting corrosion and transmissing low frequency acoustic waves less than about 500 Hz.

23. The invention according to claim 21 comprising a thin protective layer of acoustically transmissive material wrapped cylindrically around and sealing the gap between said forward and rearward segments of said bullet-like silencer to protect said sound source from corrosive elements and passing low frequency sound less than about 500 Hz.

* * * * *